US008771015B2

(12) United States Patent
Inoue et al.

(10) Patent No.: US 8,771,015 B2
(45) **Date of Patent: *Jul. 8, 2014**

(54) TERMINAL STRUCTURE OF WIRING HARNESS

(75) Inventors: Masato Inoue, Yokkaichi (JP); Kazunari Sakura, Yokkaichi (JP); Hiroshi Sudou, Yokkaichi (JP); Yukiyasu Sakamoto, Yokkaichi (JP); Hiroshi Yamaguchi, Yokkaichi (JP); Hisahiro Yasuda, Yokkaichi (JP); Tetsuya Nakamura, Yokkaichi (JP); Shigeyuki Tanaka, Yokkaichi (JP); Naoya Nishimura, Yokkaichi (JP); Daisuke Hashimoto, Yokkaichi (JP); Yukou Sato, Yokkaichi (JP)

(73) Assignees: Autonetworks Technologies, Ltd., Yokkaichi-Shi, Mie (JP); Sumitomo Wiring Systems, Ltd., Yokkaichi-Shi, Mie (JP); Sumitomo Electric Industries, Ltd., Osaka (JP)

( * ) Notice: Subject to any disclaimer, the term of this patent is extended or adjusted under 35 U.S.C. 154(b) by 34 days.

This patent is subject to a terminal disclaimer.

(21) Appl. No.: 13/699,940

(22) PCT Filed: Jul. 4, 2011

(86) PCT No.: PCT/JP2011/065293
§ 371 (c)(1),
(2), (4) Date: Nov. 26, 2012

(87) PCT Pub. No.: WO2012/011382

PCT Pub. Date: Jan. 26, 2012

(65) Prior Publication Data

US 2013/0072074 A1 Mar. 21, 2013

(30) Foreign Application Priority Data

Jul. 23, 2010 (JP) ..... 2010-165429

(51) Int. Cl.
*H01R 13/58* (2006.01)

(52) U.S. Cl.
USPC ..... 439/604

(58) Field of Classification Search
CPC ..... H01R 4/70; H01R 13/5216; H01R 43/24; H01R 13/5845
USPC ..... 439/604, 606
See application file for complete search history.

(56) References Cited

U.S. PATENT DOCUMENTS 2,973,501 A * 2/1961 Mapelsden et al. ..... 439/456
3,668,779 A * 6/1972 Turner ..... 29/858

(Continued)

FOREIGN PATENT DOCUMENTS

CN 101802098 A 8/2010
DE 198 11 333 A1 9/1999

(Continued)

OTHER PUBLICATIONS

Jan. 8, 2014 Office Action issued in Chinese Patent Application No. 201180041089.0 (with translation).

(Continued)

*Primary Examiner* — Ross Gushi
(74) *Attorney, Agent, or Firm* — Oliff PLC

(57) ABSTRACT

A terminal structure of a wiring harness for automobile use having a profound anticorrosive effect. A terminal member is fixed to a terminal portion of a coated electric wire such that a crimping portion that the member includes at its one end is crimped around a coating portion of the wire in a terminal region of the wire. A resin member completely covers at least entire outer surfaces of an exposed region at an end portion of the crimping portion and its vicinal region, and is made from a material mainly containing a thermoplastic polyamide resin, and having a tensile lap-shear strength of lapped aluminums of 6 N/mm$^2$ or more in accordance with the JIS K6850, an elongation of 100% or more in accordance with the ASTM D-1708, and a water absorption of 1.0% or less in accordance with the JIS K7209.

6 Claims, 7 Drawing Sheets

(56) References Cited

U.S. PATENT DOCUMENTS

| | | | | |
|---|---|---|---|---|
| 4,379,887 | A | 4/1983 | Overbergh | |
| 4,574,474 | A * | 3/1986 | Langham | 29/858 |
| 4,582,388 | A * | 4/1986 | Swaffield | 439/606 |
| 5,182,032 | A * | 1/1993 | Dickie et al. | 249/91 |
| 5,281,757 | A | 1/1994 | Marin et al. | |
| 5,352,741 | A | 10/1994 | Dierickx et al. | |
| 5,811,490 | A | 9/1998 | Jozokos et al. | |
| 5,885,108 | A * | 3/1999 | Gerrans, Jr. | 439/606 |
| 6,170,148 | B1 * | 1/2001 | Van Den Berg | 29/602.1 |
| 6,306,954 | B1 | 10/2001 | Nishikawa et al. | |
| 6,355,707 | B1 | 3/2002 | Jang et al. | |
| 6,514,064 | B2 * | 2/2003 | Kondo | 425/116 |
| 6,517,381 | B2 * | 2/2003 | Kondo | 439/604 |
| 6,613,263 | B2 * | 9/2003 | Kondo | 264/263 |
| 6,761,551 | B2 * | 7/2004 | Kondo | 425/116 |
| 6,796,781 | B2 * | 9/2004 | Kondo | 425/116 |
| 6,981,897 | B2 * | 1/2006 | Sakatani | 439/606 |
| 7,669,324 | B2 * | 3/2010 | Daito | 29/861 |
| 8,449,328 | B2 * | 5/2013 | Ooki | 439/606 |
| 2001/0003591 | A1 * | 6/2001 | Kondo | 425/116 |
| 2001/0003687 | A1 * | 6/2001 | Kondo | 439/604 |
| 2001/0003688 | A1 * | 6/2001 | Kondo | 439/604 |
| 2002/0119700 | A1 * | 8/2002 | Murakami | 439/606 |
| 2002/0127915 | A1 * | 9/2002 | Kondo | 439/606 |
| 2004/0092164 | A1 * | 5/2004 | Lee | 439/606 |
| 2004/0142597 | A1 * | 7/2004 | Mizutani | 439/606 |
| 2005/0165211 | A1 | 7/2005 | Nataniel et al. | |
| 2010/0160501 | A1 | 6/2010 | Tsunoda et al. | |
| 2010/0230158 | A1 | 9/2010 | Hase et al. | |
| 2011/0067921 | A1 | 3/2011 | Nonaka et al. | |
| 2012/0199391 | A1 * | 8/2012 | Inoue et al. | 174/72 A |
| 2012/0202394 | A1 * | 8/2012 | Uchiyama | 439/877 |
| 2012/0205151 | A1 * | 8/2012 | Inoue et al. | 174/72 A |
| 2012/0325552 | A1 * | 12/2012 | Sakura | 174/74 R |
| 2013/0008714 | A1 * | 1/2013 | Morikawa et al. | 174/74 R |
| 2013/0023158 | A1 * | 1/2013 | Kato et al. | 439/625 |
| 2013/0032395 | A1 * | 2/2013 | Smoll et al. | 174/84 R |
| 2013/0052887 | A1 * | 2/2013 | Inoue et al. | 439/877 |
| 2013/0056266 | A1 * | 3/2013 | Inoue et al. | 174/72 A |
| 2013/0062114 | A1 * | 3/2013 | Inoue et al. | 174/72 A |
| 2013/0072074 | A1 * | 3/2013 | Inoue et al. | 439/886 |
| 2013/0098679 | A1 * | 4/2013 | Takata et al. | 174/74 R |
| 2013/0126234 | A1 * | 5/2013 | Ono et al. | 174/75 R |
| 2013/0126235 | A1 * | 5/2013 | Tanikawa et al. | 174/77 R |
| 2013/0199842 | A1 * | 8/2013 | Inoue et al. | 174/84 |
| 2013/0213709 | A1 * | 8/2013 | Kawamura et al. | 174/72 A |
| 2013/0309903 | A1 * | 11/2013 | Iio, Kiyokazu | 439/523 |

FOREIGN PATENT DOCUMENTS

| | | | |
|---|---|---|---|
| JP | A-59-126483 | | 7/1984 |
| JP | A-59-126484 | | 7/1984 |
| JP | A-63-221507 | | 9/1988 |
| JP | A-5-159846 | | 6/1993 |
| JP | A-06-290650 | | 10/1994 |
| JP | A-07-263106 | | 10/1995 |
| JP | A-09-213137 | | 8/1997 |
| JP | A-11-92733 | | 4/1999 |
| JP | A-2000-341841 | | 12/2000 |
| JP | A-2001-135152 | | 5/2001 |
| JP | A-2001-139911 | | 5/2001 |
| JP | A-2002-201317 | | 7/2002 |
| JP | A-2003-297447 | | 10/2003 |
| JP | A-2004-111058 | | 4/2004 |
| JP | A-2005-029628 | | 2/2005 |
| JP | B2-3627846 | | 3/2005 |
| JP | B2-3627849 | | 3/2005 |
| JP | A-2008-077840 | | 4/2008 |
| JP | A-2008-308680 | | 12/2008 |
| JP | A-2009-120750 | | 6/2009 |
| JP | A-2009-230998 | | 10/2009 |
| JP | A-2009-286918 | | 12/2009 |
| JP | A-2010-006975 | | 1/2010 |
| JP | A-2010-198898 | | 9/2010 |
| WO | WO 99/35206 | A1 | 7/1999 |
| WO | WO 2009/157349 | A1 | 12/2009 |

OTHER PUBLICATIONS

Translation of Nov. 8, 2011 International Search Report issued in International Patent Application No. PCT/JP2011/068539.

Jul. 9, 2013 Office Action issued in Chinese Patent Application No. 201080051268.8 (with translation).

May 22, 2012 Office Action issued in Japanese Patent Application No. 2009-258571 (with translation).

Jan. 10, 2012 Office Action issued in Japanese Patent Application No. 2009-258571 (with translation).

Feb. 1, 2011 International Search Report issued in International Patent Application No. PCT/JP2010/070048 (with translation).

U.S. Appl. No. 13/501,035 in the name of Inoue et al., filed Apr. 9, 2012.

U.S. Appl. No. 13/807,218 in the name of Takata et al., filed Dec. 27, 2012.

Japanese Office Action issued in Application No. 2010-165429; Dated Nov. 29, 2011.

Japanese Office Action issued in Application No. 2010-165429; Dated Feb. 14, 2012.

International Search Report issued in Application No. PCT/JP2011/065293; Dated Aug. 2, 2011 (With Translation).

Oct. 31, 2013 Office Action issued in German Patent Application No. 112010004377.9 (with translation).

Dec. 26, 2013 Office Action issued in Chinese Patent Application No. 201080051268.8 (with translation).

Apr. 1, 2014 Office Action issued in Korean Patent Application No. 10-2013-7002969 (with translation).

* cited by examiner

TERMINAL STRUCTURE OF WIRING HARNESS

TECHNICAL FIELD

The present invention relates to a terminal structure of a wiring harness for automobile use.

BACKGROUND ART

Conventionally, a structure of a terminal connecting portion of a coated electric wire cited in PTL 1, for example, is used for a structure, which is waterproofed by resin molding, of a terminal portion of a wiring harness to which a corresponding terminal member is fixed.

The resin molded terminal connecting portion of the coated electric wire cited in PTL 1 is prepared by injecting a molten molding resin into a molding cavity space that is provided in a mold consisting of upper and lower molds. The molding cavity space defines a cavity for molding, in which the terminal connecting portion that is prepared by crimping a terminal member on a conductor at an end portion of the coated electric wire is housed and set for injection.

Thus, the terminal connecting portion of the coated electric wire cited in PTL 1, in which the terminal portion of the wiring harness is resin molded, produces a constant waterproof effect and anticorrosive effect.

CITATION LIST

Patent Literature

PTL1: JP3627846B

SUMMARY OF INVENTION

Technical Problem

However, in the terminal connecting portion of the coated electric wire cited in PTL 1, the molding resin is applied on a back surface of the terminal member merely to the extent of not hindering flatness of the back surface because the terminal member is installed on a flat surface such as an automobile body.

Thus, there arises a problem that because the back surface of the terminal member is not resin molded completely, a sufficient anticorrosive effect cannot be produced there.

The present invention has been made in view of the above circumstances and has an object to overcome the above problems, and to provide a terminal structure of a wiring harness for automobile use that has a profound anticorrosive effect.

Solution to Problem

The terminal structure of the wiring harness for automobile use of the present invention includes a coated electric wire including a plurality of bare conductors, a coating portion with which the bare conductors are coated and an exposed portion at an end of the electric wire, where the conductors are exposed, a terminal member that is fixed to the coated electric wire, and includes a crimping portion at its one end that is fixed to the coated electric wire by being crimped around an outer surface of the coating portion of the electric wire in the vicinity of the exposed portion, and a resin member that covers at least an entire outer surface of an exposed region at an end portion of the crimping portion, and an entire outer surface of a region in the vicinity of the exposed region, wherein the resin member is made from a material that mainly contains a thermoplastic polyamide resin, and has a tensile lap-shear strength of lapped aluminums of 6 $N/mm^2$ or more, which is measured in accordance with the JIS K6850, an elongation of 100% or more, which is measured in accordance with the ASTM D-1708, and a water absorption of 1.0% or less, which is measured in accordance with the JIS K7209.

It is preferable that the thermoplastic polyamide resin contains at least one of a dimer acid and a dicarboxylic acid, and a diamine.

It is preferable that the terminal member includes a plated region that defines a surface that is coated with plating, and that the exposed region at the end portion of the crimping portion includes a no-plated region that is uncoated with plating.

It is preferable that the bare conductors are made from a material containing aluminum, the terminal member is made from a material containing copper, and the plating for the plated region is made from a material containing tin.

Advantageous Effects of Invention

In the present invention, because the resin member covers the entire outer surface of the exposed region at the end portion of the crimping portion and the entire outer surface of the region in the vicinity of the exposed region, a risk that an electrolytic solution enters from the exposed region at the end portion of the crimping portion and erodes the material of the crimping portion to finally erode a portion of the bare conductors can be avoided in a convincing way. Further, being made from the material that mainly contains the thermoplastic polyamide resin, and has the physical properties of tensile lap-shear strength, elongation and water absorption that fall within the specific ranges, the resin member can contribute to improvement in anticorrosive performance from the view point of material.

As a result, the terminal structure of the wiring harness for automobile use has an enhanced anticorrosive effect.

If the thermoplastic polyamide resin contains at least one of the dimer acid and the dicarboxylic acid, and the diamine, a harmonious balance can be maintained among the physical properties of tensile lap-shear strength, elongation, water absorption and melt viscosity, which allows the resin to have a coating property during the time the resin member is formed and an anticorrosive capability after the resin member is formed that are well balanced.

If the terminal member includes the plated region that defines the surface that is coated with plating, and the exposed region at the end portion of the crimping portion includes the no-plated region that is uncoated with plating, the resin member can avoid a risk in a convincing way that an electrolytic solution enters from the exposed region at the end portion of the crimping portion to finally erode a portion of the bare conductors.

Thus, even though the exposed region at the end portion of the crimping portion includes the no-plated region that is uncoated with plating because of a processing treatment to produce the crimping portion, the exposed region need not be coated with plating again, which can lower the cost of production for the terminal member including the crimping portion.

In addition, the combined use of the copper from which the terminal member is made and the aluminum from which the bare conductors are made could cause high-rate consecutive erosion over the terminal member and the bare conductors; however, the resin member can avoid in a convincing way a risk that an electrolytic solution enters from the exposed region to finally erode a portion of the bare conductors.

Because the terminal member is made from copper that is a favorable material for the terminal member, and the bare conductors are made from aluminum that is a favorable material for the bare conductors in this case, the terminal structure of the wiring harness can be made easy to use.

DESCRIPTION OF EMBODIMENTS

Preferred Embodiment (Structure)

Figure 1:
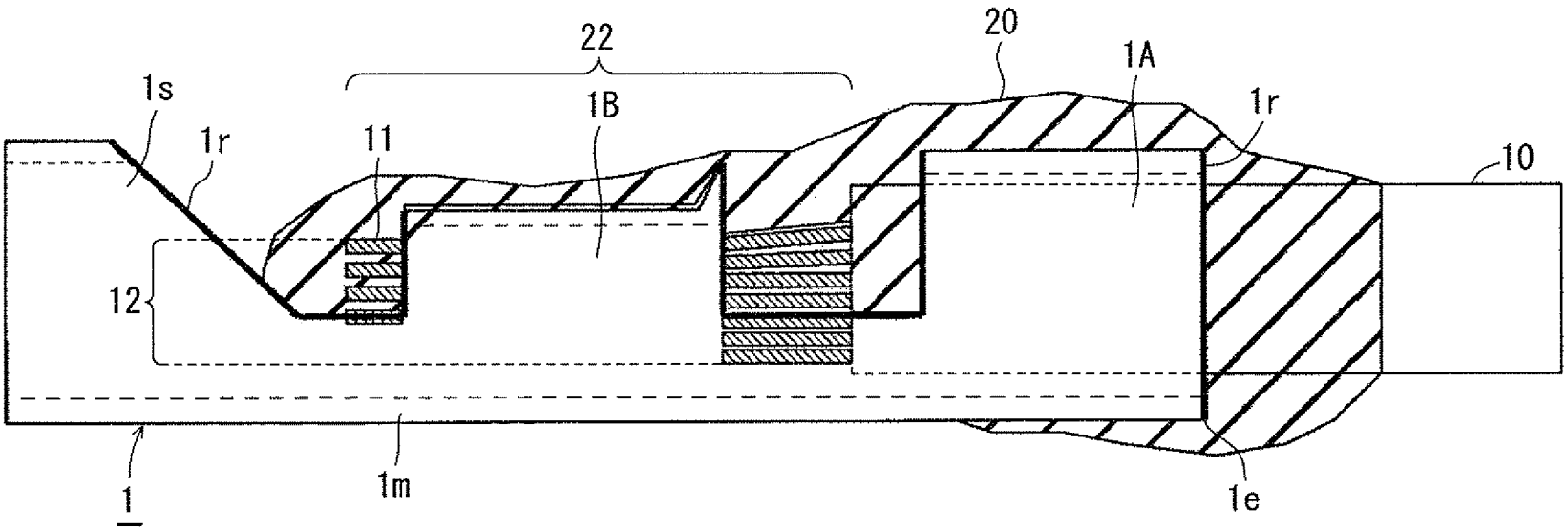
FIG. 1 is a view schematically showing a cross section terminal structure of a wiring harness for automobile use of a preferred embodiment of the present invention.

FIG. 1 is a view schematically showing a cross section terminal structure of a wiring harness for automobile use of a preferred embodiment of the present invention.

As shown in FIG. 1, a coated electric wire 10 including a plurality of bare conductors 11 and a coating portion 13 (not shown) with which the bare conductors 11 are insulation coated includes an exposed portion 22 at its end where a portion of a conductor group 12 consisting of the plurality of bare conductors 11 is exposed. The bare conductors 11 are made preferably from aluminum.

A terminal member 1 is fixed to a terminal portion of the coated electric wire 10. To be specific, the terminal member 1 is fixed to the terminal portion of the coated electric wire 10 such that a crimping portion 1A, which the terminal member 1 includes at its one end, is crimped around an outer surface of the coating portion of the coated electric wire 10, and a crimping portion 1B, which the terminal member 1 includes at a position inner than the crimping portion 1A, is crimped around an outer surface of the conductor group 12 at the exposed portion 22 in a terminal region of the coated electric wire 10. The terminal member 1 is made preferably from brass or a copper alloy.

The terminal member 1 includes a plated region 1*m* that is prepared in advance by coating a surface of the terminal member 1 with tin plating, while a fracture cross section 1*r* exists on a surface of the terminal member 1 where the copper is exposed, which is exposed during a processing treatment to produce the crimping portions 1A and 1B. A surface portion of the fracture cross section 1*r* is indicated with a thick line in FIG. 1.

A resin member 20 is formed so as to completely cover at least an entire outer surface of an exposed region at an end portion of the crimping portion 1A (a region including the fracture cross section 1*r* and a root edge portion 1*e* shown in the right part of FIG. 1), and an entire outer surface of a region in the vicinity of the exposed region. Further, the resin member 20 is formed over an upper region of the terminal member 1 from the crimping portion 1A to the exposed portion 22 and the crimping portion 1B. The resin member 20 is preferably a molded object prepared in a molding method, considering that size setting can be easily controlled. The resin member 20 can be molded also by a falling-drop method, a coating method or an extrusion method.

Figure 2:
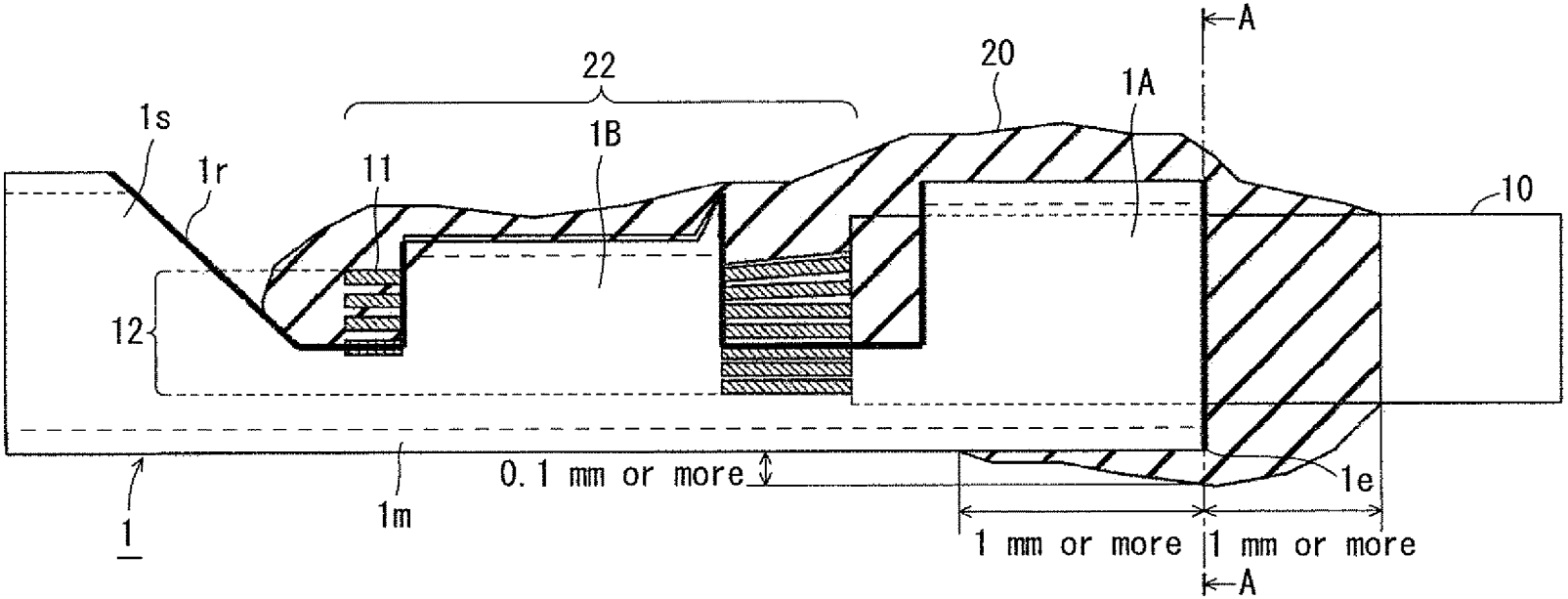
FIG. 2 is a view showing size properties of the terminal structure of the wiring harness of the present embodiment.

FIG. 2 is a view showing size properties of the terminal structure of the wiring harness of the present embodiment. The resin member 20 is formed 1 mm or more long in a direction to one end of the terminal member 1 (a direction to the coated electric wire 10), and the formed 1 mm or more long in a direction to the other end of the terminal member 1 (a direction to the crimping portion 1B and the conductor group 12) from the root edge portion 1*e* of the exposed region at the end portion on a back surface of the crimping portion 1A as shown in FIG. 2. In addition, the thickness of the resin member 20 at the root edge portion 1*e* is set to be 0.1 mm or more.

Thus, the formed resin member 20 has the size properties such as to completely cover the root edge portion 1*e*, and completely avoid an adverse effect of eroding the tin that is the plating material of the plated region 1*m*.

Figure 3:
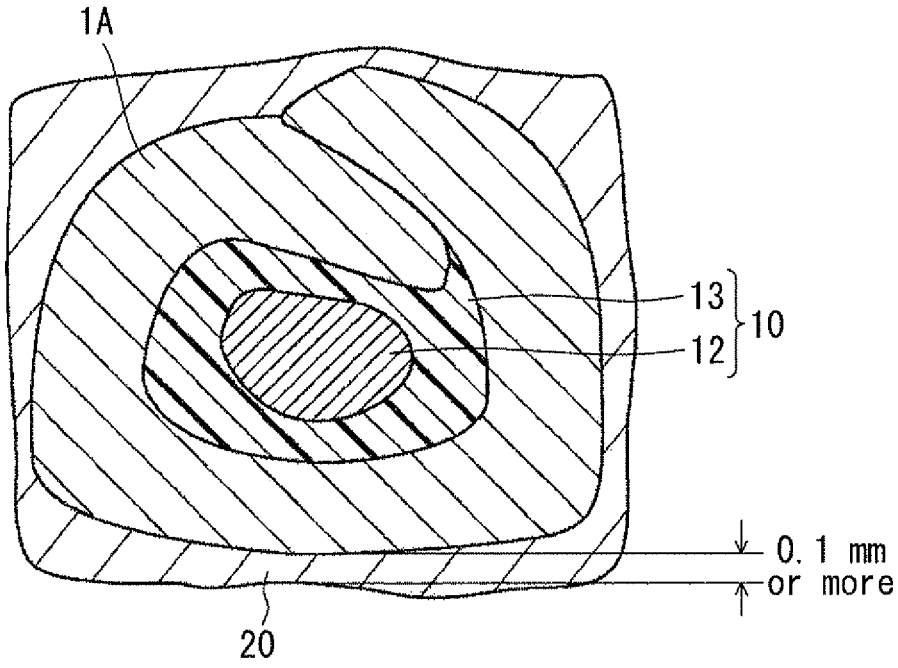
FIG. 3 is a cross-sectional view showing the terminal structure along the line A-A of FIG. 2.

FIG. 3 is a cross-sectional view showing the terminal structure along the line A-A of FIG. 2. The resin member 20 is, as shown in FIG. 3, formed so as to completely cover the entire outer surface of the crimping portion 1A in section along the line A-A of FIG. 2 (in section at the one end of the terminal member 1 (the crimping portion 1A)). To be specific, the resin member 20 having the thickness of 0.1 mm or more is formed so as to cover the entire outer surface of the crimping portion 1A. The coated electric wire 10 includes the conductor group 12 and the coating portion 13 with which the conductor group 12 is coated as shown in FIG. 3.

In the terminal structure of the wiring harness of the present embodiment, the resin member 20 is made from a material for forming a resin member that mainly contains a thermoplastic polyamide resin. The thermoplastic polyamide resin preferably contains at least one of a dimer acid and a dicarboxylic acid, and a diamine. This is because a harmonious balance can be maintained among physical properties such as tensile lap-shear strength, elongation, water absorption and melt viscosity of the material, which allows the material to have a coating property and an anticorrosive capability that are well balanced.

It is preferable that the resin-member forming material contains a single kind of thermoplastic polyamide resin, or two or more different kinds of thermoplastic polyamide resins. Further, it is preferable that the resin-member forming material contains an additive and another polymer as appropriate within a range of not impairing its physical properties.

The additive described above is not limited specifically as long as it defines an additive that can be generally used for a material for resin molding. To be specific, examples of the additive include an inorganic filler, an antioxidant, a metal deactivator (a copper inhibitor), an ultraviolet absorber, an ultraviolet-concealing agent, a flame-retardant auxiliary agent, a processing aid (e.g., a lubricant, wax), and carbon and other coloring pigments.

It is preferable that the resin-member forming material is cross-linked as appropriate in order to increase heat resistance and mechanical strength. Examples of a method for the crosslinking include a thermal crosslinking method, a chemical crosslinking method, a silane crosslinking method, an electron irradiation crosslinking method, and an ultraviolet crosslinking method, which are not limited specifically. The resin-member forming material is preferably cross-linked after the resin member 20 is formed.

The resin-member forming material has a tensile lap-shear strength of lapped aluminums of 6 N/mm$^2$ or more, which is measured in accordance with the JIS K6850. It is to be noted that the JIS K6850 ("Adhesives—Determination of tensile lap-shear strength of rigid-to-rigid bonded assemblies") stipulates determination of tensile lap-shear strength of rigid-to-rigid bonded assemblies by using a standard test specimen under specified adjustment and test conditions. In the present invention, aluminum plates are used as the rigid-to-rigid bonded assemblies and the resin-member forming material is used as a bonding layer sandwiched by the aluminum plates, and thus a test specimen is prepared.

If the tensile lap-shear strength of lapped aluminums is less than 6 N/mm$^2$, it is difficult to bring the resin-member forming material, even melted, into intimate contact with a portion where corrosion prevention is needed. Thus, it is difficult for the resin member to obtain a high anticorrosion effect. The tensile lap-shear strength of lapped aluminums is preferably 7 N/mm$^2$ or more, and more preferably 8 N/mm$^2$ or more. The upper limit of the tensile lap-shear strength of lapped aluminums is not limited specifically because it is preferable that the present resin-member forming material has sufficient adhesion.

The resin-member forming material has an elongation (at normal temperature of 24 degrees C.) of 100% or more, which is measured in accordance with the ASTM D-1708.

If the elongation is less than 100%, a shrinkage crack is produced more often in the resin member when the material is cooled and hardened after melted and applied on a portion where corrosion prevention is needed. Due to this, water is immersed into the crack, so that it is difficult for the resin member to obtain a high anticorrosion effect. The elongation is preferably 150% or more, and more preferably 200% or more. The upper limit of the elongation is not limited specifically because it is preferable that the resin-member forming material has a sufficient elongation.

The resin-member forming material has a water absorption of 1.0% or less, which is measured in accordance with the JIS K7209. The water absorption defines a value that is measured in an A-method under the conditions that an immersion period is 7 days, and the shape of test specimen is a sheet shape.

If the water absorption is more than 1.0%, the resin member is liable to absorb water depending on its use environment such as car environment. Therefore, it is difficult for the resin member to obtain a high anticorrosion effect. The water absorption is preferably 0.8% or less, and more preferably 0.5% or less. The lower limit of the water absorption is not limited specifically because it is preferable that the resin-member forming material has a lower water absorption.

(Comparison with Conventional Structure)

Figure 4:
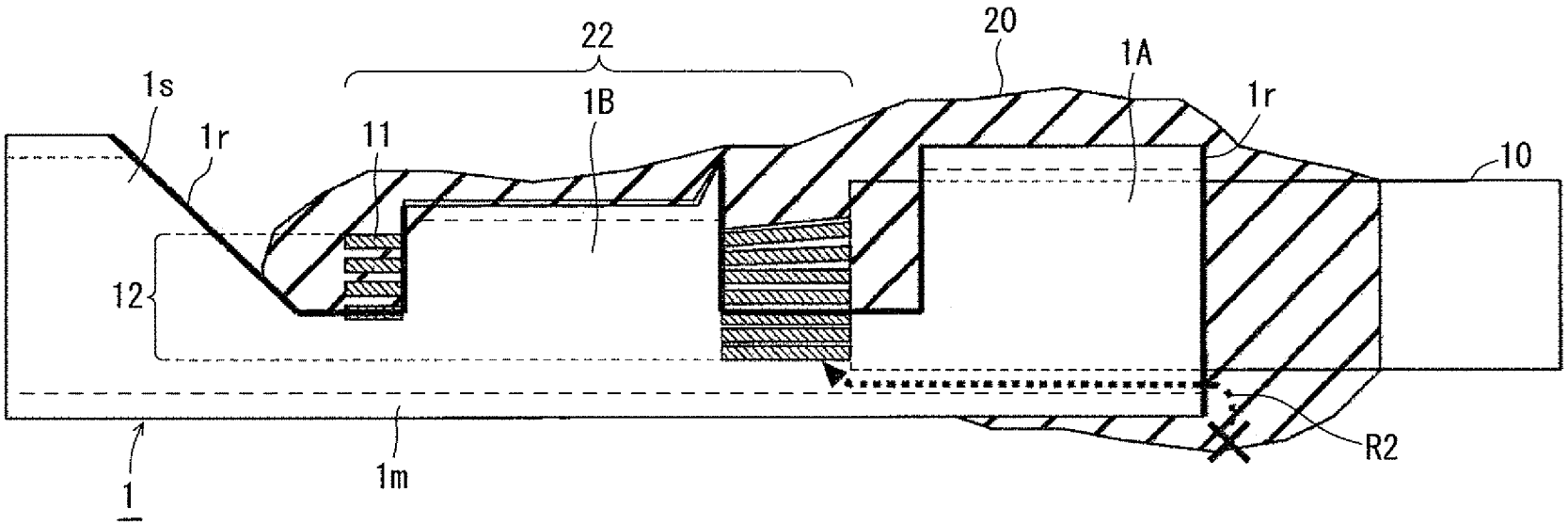
FIG. 4 is a view for illustrating an effect achieved by the present embodiment.
Figure 6:
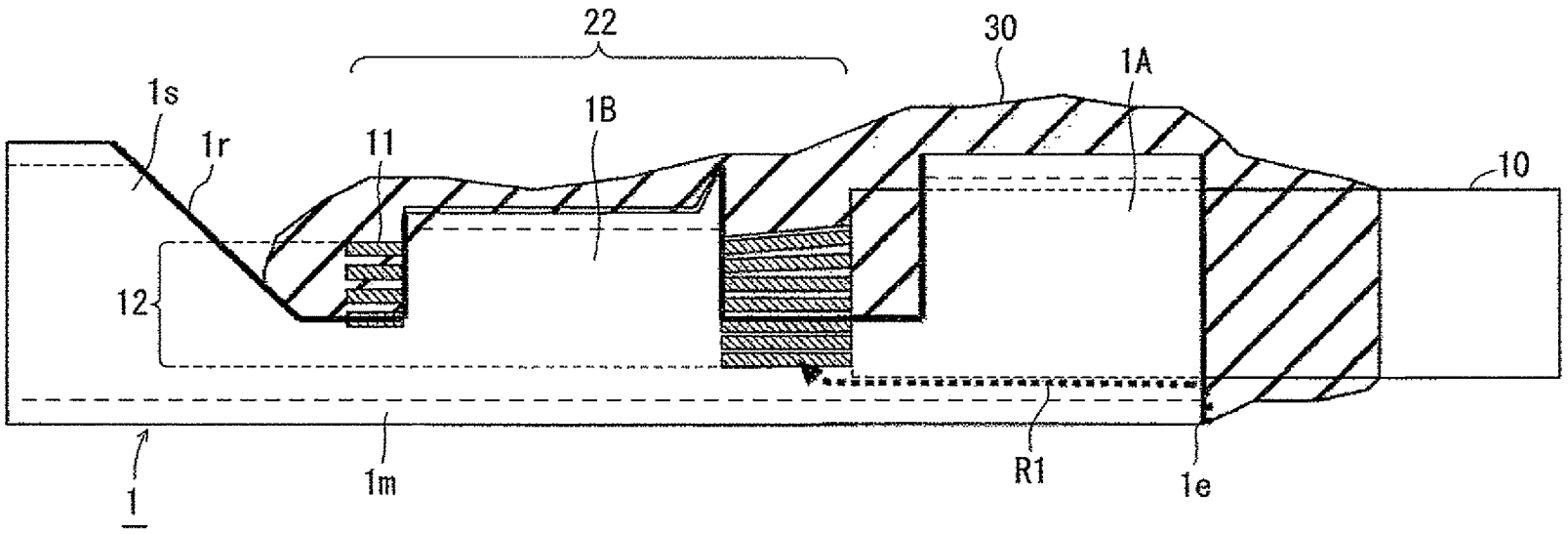
FIG. 6 PRIOR ART
FIG. 6 is a view showing a conventional terminal structure of a wiring harness that corresponds to the present embodiment.

FIGS. 4 and 6 are views for illustrating an effect of the present embodiment. FIG. 4 is a view showing the terminal structure of the wiring harness of the present embodiment. FIG. 6 is a view showing a conventional terminal structure of a wiring harness that corresponds to the present embodiment.

A description of the structure shown in FIG. 4 is omitted because it is same as the descriptions provided above referring to FIGS. 1 to 3. In the conventional terminal structure shown in FIG. 6, a resin member 30 is formed so as to cover a back surface of the coated electric wire 10 until the root edge portion 1*e* of the crimping portion 1A. However, not formed on the back surface of the crimping portion 1A, the resin member 30 is not formed so as to completely cover the region including the root edge portion 1*e*.

Because of this, a possibility cannot be avoided in a convincing way such that an electrolytic solution such as seawater enters from the root edge portion 1*e*, and while eroding the brass or the copper alloy from which the terminal member 1 (the crimping portion 1A) is made and the tin that is plated on the terminal member 1, enters through a path R1 of the electrolytic solution. As a result, when the electrolytic solution reaches the conductor group 12 through the path R1, the aluminum from which the bare conductors 11 are made is eroded because the aluminum has a stronger ionization tendency than the brass and the copper alloy from which the terminal member 1 is made.

As described above, the resin member 30 of the conventional terminal structure of the wiring harness as cited in PTL 1, for example, does not completely cover the root edge portion 1*e* of the crimping portion 1A, so that the path R1 cannot be blocked completely. As a result, a risk of erosion of the bare conductors 11 is raised.

Meanwhile, in the terminal structure of the wiring harness of the present embodiment 1, the resin member 20 is formed so as to completely cover the entire outer surface of the exposed region at the end portion of the crimping portion 1A that includes the root edge portion 1*e* as shown in FIG. 4 (and FIGS. 1 to 3). Thus, a virtual path R2 of the electrolytic solution that extends from the fracture cross section 1*r* at the one end of the terminal member 1 can be blocked completely as shown in FIG. 4.

As described above, in the terminal structure of the wiring harness of the present embodiment, the resin member 20 completely covers the entire outer surface of the exposed region at the end portion of the crimping portion 1A that is defined as the fracture cross section 1*r*, and the entire outer surface of the region in the vicinity of the exposed region, so that a risk that an electrolytic solution enters from the fracture cross section 1*r* (the root edge portion 1*e*) that defines the exposed region and erodes the brass or the copper alloy of the crimping portion 1A and the tin plated on the crimping portion 1A to finally erode a portion of the bare conductors 11 can be avoided in a convincing way.

Further, being made from the material that mainly contains the thermoplastic polyamide resin, and has the physical properties of tensile lap-shear strength, elongation and water absorption that fall within the specific ranges, the resin member 20 can contribute to improvement in anticorrosive performance from the view point of material.

As a result, an effect of obtaining the terminal structure of the wiring harness for automobile use that has a profound anticorrosive effect is achieved. Thus, the bare conductors 11 can maintain their stable electric performance.

In addition, though the exposed region at the end portion of the crimping portion 1A includes the no-plated region (the fracture cross section 1*r*) that is not the plated region 1*m*, the resin member 20 formed as described above can avoid in a convincing way a risk that an electrolytic solution enters from the exposed region to finally erode a portion of the bare conductors.

Thus, even though the exposed region at the end portion of the crimping portion 1A includes the fracture cross section 1*r* that is uncoated with plating because of a processing treatment to produce the crimping portion 1A from the terminal member 1, the exposed region need not be coated with plating again, which can lower the cost of production for the terminal member 1 including the crimping portion 1A.

In addition, the combined use of the brass or the copper alloy from which the terminal member 1 is made and the aluminum from which the bare conductors 11 are made as described in the present embodiment could cause high-rate consecutive erosion over the terminal member 1 and the bare conductors 11; however, the resin member 20 can avoid in a convincing way a risk that an electrolytic solution enters from the exposed region to finally erode a portion of the bare conductors 11.

For this reason, the terminal member 1 is made from copper that is a favorable material for the terminal member 1, and the bare conductors 11 are made from aluminum that is a favorable material for the bare conductors 11, so that the terminal structure of the wiring harness can be made easy to use.

Another Preferred Embodiment

Figure 5:
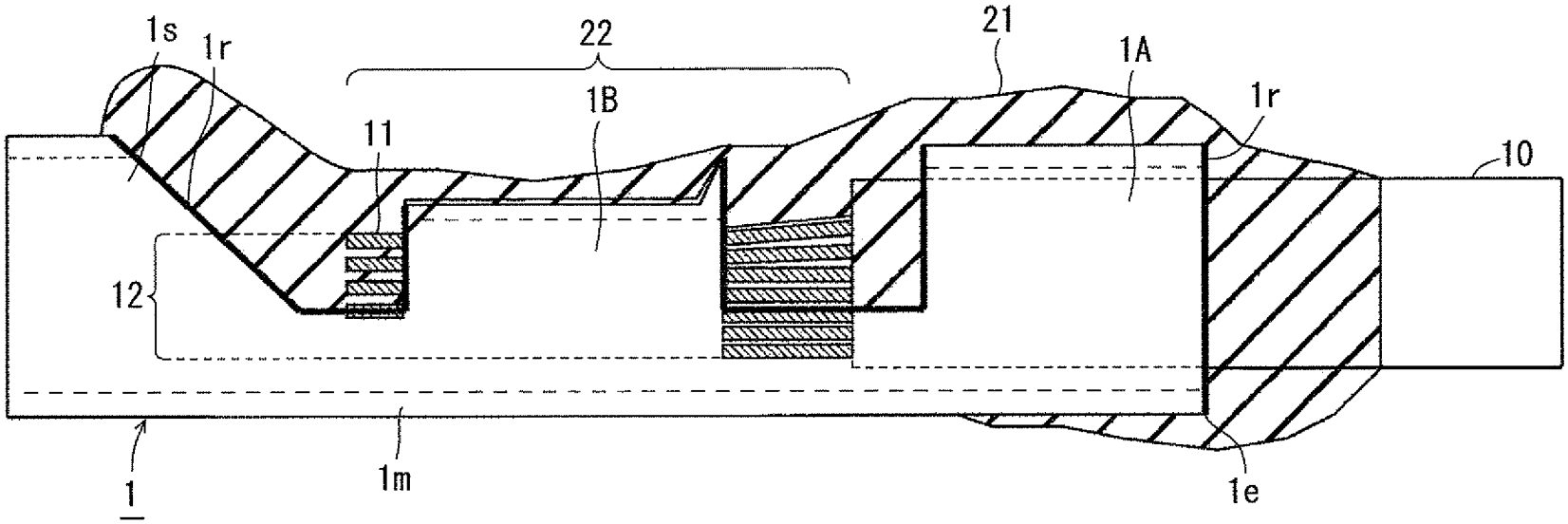
FIG. 5 is a view schematically showing another preferred embodiment of the present invention.

FIG. 5 is a view schematically showing another preferred embodiment of the present invention. In the present embodiment, a resin member 21 is formed also on a fracture cross section 1*r* at the other end 1*s* of the terminal member 1 as shown in FIG. 5. The resin member 21 is formed also on portions same as the resin member 20 shown in FIGS. 1 to 4. The structure of the present embodiment is same as the structure shown in FIGS. 1 to 4, except that the resin member 30 is replaced with the resin member 21.

The configuration of the resin member 21 formed also on the fracture cross section 1*r* at the other end is of the terminal member 1 as shown in FIG. 5 can enhance an effect of preventing erosion of the bare conductors 11 from being caused by an electrolytic solution that enters from the fracture cross section 1*r* at the other end 1*s*.

As described above, in the terminal structure of the wiring harness of the present embodiment, the resin members 21 are provided to all of the fracture cross sections 1*r* (no-plated regions) of the terminal member 1, so that an effect of preventing erosion of the bare conductors 11 from being caused by erosion of the brass or the copper alloy of the terminal member 1 in a more convincing way can be enhanced.

Example

A description of the present invention will now be specifically provided with reference to Examples. It is to be noted that the present invention is not limited to the Examples.

1. Preparation of Coated Electric Wire

A polyvinyl chloride composition was prepared as follows: 100 parts by mass of polyvinyl chloride (polymerization degree of 1300), 40 parts by mass of diisononyl phthalate that defined a plasticizer, 20 parts by mass of calcium carbonate heavy that defined a filler, and 5 parts by mass of a calcium-zinc stabilizer that defined a stabilizer were mixed at 180 degrees C. in an open roll, and the mixture was formed into pellets with the use of pelletizer.

Then, a conductor group (having a cross-sectional area of 0.75 mm) that defined an aluminum alloy strand that was made up of seven aluminum alloy wires was extrusion-coated with the polyvinyl chloride composition prepared as above such that the coat had a thickness of 0.28 mm with the use of 50 mm extruder. Thus, coated electric wires (PVC electric wires) were prepared.

2. Crimp of Terminal Member and Formation of Resin Member

The coat was peeled off at an end of each coated electric wire to expose each wire conductor group, and then a male crimping terminal member (0.64 mm in width at a tab, the member including a crimping portion at the conductor group and a crimping portion at the coating portion) made from brass generally used for automobile was crimped onto the end of each coated electric wire.

Then, materials for forming resin members of different kinds that are to be described later were applied over the crimping portions at the coating portions of the terminal members, the exposed portions of the electric wires, and the crimping portions at the conductor groups of the terminal members so as to cover outer surfaces of exposed regions at end portions of the crimping portions at the coating portions, and outer surfaces of regions in the vicinity of the exposed regions, and thus resin members were formed. During the formation of the resin members, the resin-member forming materials were heated to 230 degrees C. to liquefy, and applied to be 0.1 mm in thickness and solidified.

Example 1

Thermoplastic polyamide resin (A) [manuf.: HENKEL JAPAN LTD., "MACROMELT (a registered trade mark) 6801"]

Example 2

Thermoplastic polyamide resin (B) [manuf.: HENKEL JAPAN LTD., "MACROMELT (a registered trade mark) JP116"]

Example 3

Thermoplastic polyamide resin (C) [manuf.: HENKEL JAPAN LTD., "MACROMELT (a registered trade mark) 6301"]

Comparative Example 1

Thermoplastic polyamide resin (a) [manuf.: HENKEL JAPAN LTD., "MACROMELT (a registered trade mark) 6217"]

Comparative Example 2

Thermoplastic polyamide resin (b) (manuf.: HENKEL JAPAN LTD., "MACROMELT (a registered trade mark) 6030")

Comparative Example 3

Thermoplastic polyamide resin (c) [manuf.: HENKEL JAPAN LTD., "MACROMELT (a registered trade mark) 6880"]

3. Evaluation Procedure

Evaluations of anticorrosive capability of the resin members were performed on the coated electric wires with the terminals by detecting the presence or absence of a crack formed in the resin members.

(Crack)

After coated with the resin-member forming materials of different kinds, the coated electric wires with the terminals were left in the air for one day, and the visual detection of the presence or absence of a crack formed in the resin members was performed by using a microscope. The coated electric wires with the terminals in which cracks were absent in the resin members were evaluated as PASSED. The coated electric wires with the terminals in which cracks were present in the resin members were evaluated as FAILED.

(Anticorrosive Capability)

Figure 7:
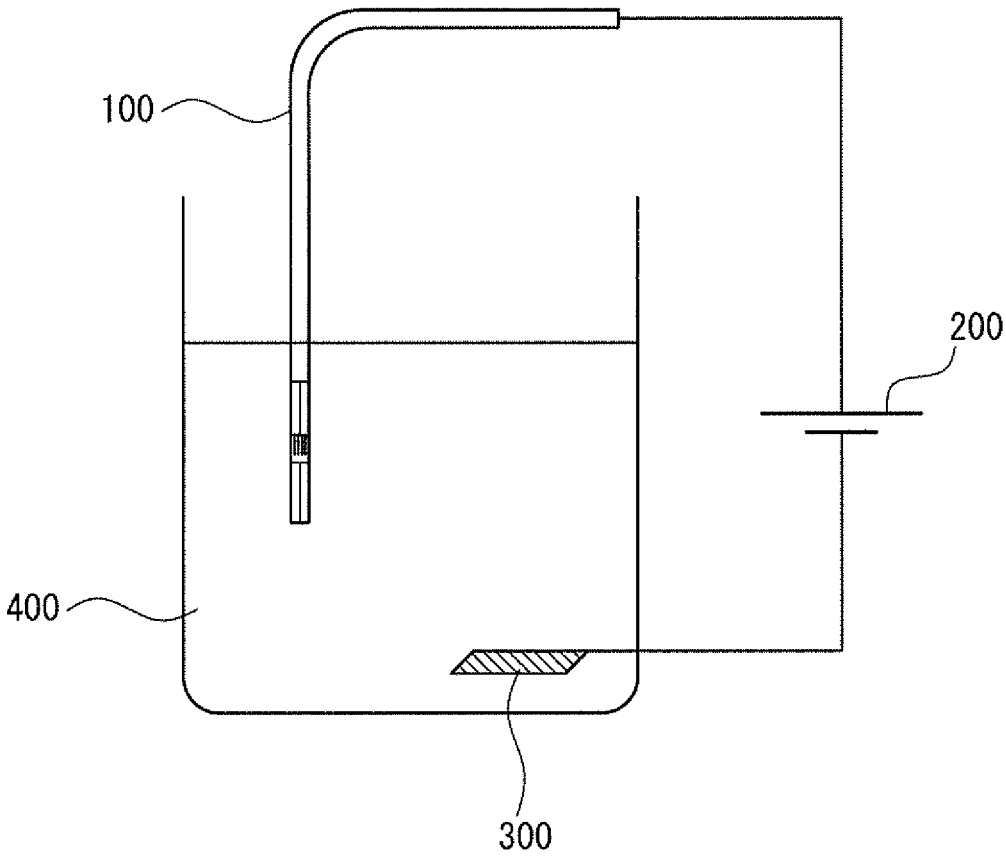
FIG. 7 is a view for illustrating a corrosion testing method used in Example.

As shown in FIG. 7, each of the prepared coated electric wires 100 with the terminals was connected to a positive electrode of an electrical power source 200 of 12 volts, while a pure copper plate 300 (1 cm in width×2 cm in length×1 mm in thickness) was connected to a negative electrode of the electrical power source 200 of 12 volts. Each of the crimping portions of the terminal members on the conductor groups of the coated electric wires 100, and the pure copper plate 300 were immersed in 300 cc of a water solution 400 containing 5% of NaCl, and a voltage of 12 volts was applied thereto for two minutes. After the application of the voltage, ICP emission analysis of the water solution 400 was performed to measure the amounts of aluminum ions eluted from the conductor groups of the coated electric wires 100 with the terminals. The coated electric wires with the terminals in which the amounts of aluminum ions eluted from the conductor groups were less than 0.1 ppm were evaluated as PASSED. The coated electric wires with the terminals in which the amounts of aluminum ions eluted from the conductor groups were 0.1 ppm or more were evaluated as FAILED.

Tensile lap-shear strengths of lapped aluminums of the resin-member forming materials of the Examples and the Comparative Examples, which were measured in accordance with the JIS K6850, elongations (at normal temperature of 24 degrees C.) of the resin-member forming materials of the Examples and the Comparative Examples, which were measured in accordance with the ASTM D-1708, and water absorptions of the resin-member forming materials of the Examples and the Comparative Examples, which were measured in accordance with the JIS K7209 (A-method under the conditions that an immersion period is 7 days, the shape of test specimens is a sheet shape), and evaluation results of the resin-member forming materials of the Examples and the Comparative Examples are presented in Table 1.

TABLE 1

| | | Example 1 | Example 2 | Example 3 | Comparative Example 1 | Comparative Example 2 | Comparative Example 3 |
|---|---|---|---|---|---|---|---|
| Tensile lap-shear strength (Al/Al) | (N/mm2) | 10.8 | 10.8 | 6.7 | 2.1 | 4.4 | 3.4 |
| Elongation | (%) | 1000 | 780 | 840 | 120 | 20 | 96 |
| Water absorption (7 days) | (%) | 0.78 | 0.89 | 0.43 | 1.5 | 0.23 | 2.34 |
| Crack | | PASSED | PASSED | PASSED | PASSED | FAILED | FAILED |
| Anticorrosive capability | | PASSED | PASSED | PASSED | FAILED | FAILED | FAILED |

As is evident from Table 1, the resin member of Comparative Example 1, which is made of the material of which the tensile lap-shear strength and the water absorption fall outside the ranges defined by the present invention, is insufficient in adhesion, liable to absorb water, and inferior in anticorrosive capability.

The resin member of Comparative Example 2, which is made of the material of which the tensile lap-shear strength and the elongation fall outside the ranges defined by the present invention, is insufficient in adhesion, and inferior in anticorrosive capability because water is immersed into a formed crack.

The resin member of Comparative Example 3, which is made of the material of which the tensile lap-shear strength, the elongation and the water absorption fall outside the ranges defined by the present invention, is insufficient in adhesion, liable to absorb water, and inferior in anticorrosive capability because water is immersed into a formed crack.

Meanwhile, all of the resin members of the Examples, which are made of the materials of which the tensile lap-shear strengths, the elongations and the water absorptions fall within the ranges defined by the present invention, have sufficient adhesion to the electrically connected portions, and can prevent water absorption. In addition, the resin members of the Examples are excellent in coating property compared with grease. In addition, a shrinkage crack due to cooling is seldom produced in the resin members of the Examples after application. Thus, the resin members of the Examples are capable of delivering high anticorrosive capability.

The foregoing description of the preferred embodiments of the present invention has been presented for purposes of illustration and description; however, it is not intended to be exhaustive or to limit the present invention to the precise form disclosed, and modifications and variations are possible as long as they do not deviate from the principles of the present invention.

The invention claimed is:

1. A terminal structure of a wiring harness for automobile use, the terminal structure comprising:

a coated electric wire comprising:

a plurality of bare conductors;

a coating portion with which the bare conductors are coated; and an exposed portion at an end of the electric wire, where the conductors are exposed;

a terminal member that is fixed to the coated electric wire, and comprises a crimping portion at its one end that is fixed to the coated electric wire by being crimped around an outer surface of the coating portion of the electric wire in the vicinity of the exposed portion; and a resin member that covers at least an entire outer surface of an exposed region at an end portion of the crimping portion, and an entire outer surface of a region in the vicinity of the exposed region, wherein the resin member is made from a material that mainly contains a thermoplastic polyamide resin, and has a tensile lap-shear strength of lapped aluminums of 6 $N/mm^2$ or more, which is measured in accordance with the JIS K6850;

an elongation of 100% or more, which is measured in accordance with the ASTM D-1708; and a water absorption of 1.0% or less, which is measured in accordance with the JIS K7209.

2. The terminal structure according to claim 1, wherein the thermoplastic polyamide resin contains:

at least one of a dimer acid and a dicarboxylic acid; and a diamine.

3. The terminal structure according to claim 2, wherein the terminal member comprises a plated region that defines a surface that is coated with plating, and wherein the exposed region at the end portion of the crimping portion comprises a no-plated region that is uncoated with plating.

4. The terminal structure according to claim 3, wherein the bare conductors are made from a material containing aluminum, the terminal member is made from a material containing copper, and the plating for the plated region is made from a material containing tin.

5. The terminal structure according to claim 1, wherein the terminal member comprises a plated region that defines a surface that is coated with plating, and wherein the exposed region at the end portion of the crimping portion comprises a no-plated region that is uncoated with plating.

6. The terminal structure according to claim 5, wherein the bare conductors are made from a material containing aluminum, the terminal member is made from a material containing copper, and the plating for the plated region is made from a material containing tin.

* * * * *